US006068128A

United States Patent [19]

Gardner

[11] Patent Number: 6,068,128

[45] Date of Patent: May 30, 2000

[54] BOTTOM SEAL BAG FOR USE WITH WICKETS

[75] Inventor: James G. Gardner, McDonough, Ga.

[73] Assignee: Tara Plastics Corp., Forrest Park, Ga.

[21] Appl. No.: 09/143,013

[22] Filed: Aug. 28, 1998

[51] Int. Cl.[7] ..... B65D 33/14

[52] U.S. Cl. ..... 206/554; 383/9

[58] Field of Search ..... 383/9; 206/554

[56] References Cited

U.S. PATENT DOCUMENTS

| | | | |
|---|---|---|---|
| 3,044,233 | 7/1962 | Altman, Jr. | 206/554 |
| 3,454,166 | 7/1969 | Dinges | 206/554 |
| 4,759,639 | 7/1988 | DeMatteis | 206/554 |
| 4,779,996 | 10/1988 | Sengewald | 383/9 |
| 4,903,839 | 2/1990 | Mattiebe et al. | 383/9 |
| 4,981,216 | 1/1991 | Wilfong, Jr. | 206/554 |
| 4,988,213 | 1/1991 | Mattle | 383/6 |
| 4,995,860 | 2/1991 | Wilfong, Jr. | 206/554 |
| 5,062,716 | 11/1991 | Conrad et al. | 206/554 |
| 5,497,884 | 3/1996 | DeMatteis | 206/554 |
| 5,690,228 | 11/1997 | DeMatteis | 206/554 |

*Primary Examiner*—Stephen P. Garbe
*Attorney, Agent, or Firm*—Kenneth S. Watkins, Jr.

[57] ABSTRACT

A bottom-seal bag for wickets comprises wicket holes positioned outside an interior side gusset fold when the bag is in a lay-flat condition. The wicket hoes pass through the back panel and side gussets, and in some embodiments, the front panel. Front cut lines in the front panel and front gusset portion reduce the separation force of the front panel of the bag from the wicket as compared to the back panel of the bag. The front cut lines are positioned outside the interior side gusset fold in a lay-flat condition. The cut lines may be continuous or non-continuous. The cut lines allow the front panel and front gusset portions of the bag to be easily separated from the wicket with a low pulling force to reduce operator fatigue and improve reliability of bag filling and separation operations. Additional pulling force separates the back panel and back gusset portion from the wicket, completely releasing the bag.

12 Claims, 4 Drawing Sheets

BOTTOM SEAL BAG FOR USE WITH WICKETS

BACKGROUND OF THE INVENTION

The present invention relates to product bags and, more particularly, to product bags supportable on support wickets.

Bags supported and dispensed by wickets are in common use for packaging operations which require a large number of bags for packaging products such as food products, manufactured articles, and apparel. Normally, a group or stack of bags are supported on a structure by the prongs of the wickets inserted in wicket holes in the bags. The bags are removed from the wicket by pulling or otherwise providing a removal force which tears or extends the wicket hole to the top edge of the bag, releasing the bag. This support means allows quick and easy removal of the bags before or after product filling.

Wicket bags normally comprise a lip or raised back panel. These bags, often called "side sealed" bags are made by folding a film web, forming the bottom of the bag and leaving an overlapping lip on the back panel. The bag is completed by side welding or sealing the bag, and cutting lengthwise. The wicket holes in a lip type bag extend through the back panel, but not normally through the front panel. In this manner, the front panel is easily opened since it is not restrained by the wicket prongs. The bag is easily filled with product, and is easily removed since the front of the bag may be gripped by the hand or automated equipment.

Lipless bags, also called "bottom seal" bags, are popular in the packaging industry due to their simplicity and ability to be made quickly and economically. For example, lipless bags are made from seamed or seamless film tubes by seal welding the bottom and then slitting transversely during or after the weld. The weld provides the bottom of the first bag and the slit forms the top of the next sequential bag. Gussets may be formed in the sides of the bag during manufacture and provide better product fit and additional bag capacity.

A problem arises when supporting lipless bags on wickets since wicket holes extend through the front of the bag as well as the back of the bag. The front of the bag is difficult to open and grip for filling and bag removal since the wicket prongs retain the front of the bag on the support. This is especially a problem for highly repetitive operations, since extra separation force is required to separate the front of the bag from the wicket. Such a method increases the possibility of operator fatigue, and missed bagging operations, whether done manually or by automated equipment. Converting a lipless bag into a lip type bag requires additional manufacturing steps which add cost and slow the bag-making process.

OBJECTS AND SUMMARY OF THE INVENTION

Therefore an object of the present invention is to provide a lipless bag capable of being supported and easily opened and removed from a wicket.

A further object of the invention is to provide a bottom seal bag for support from wickets which is easily manufactured.

A further object of the present invention is to provide side gussets to the bag for improved product fit.

Yet a further object of the present invention is to provide a lipless bag capable of being supported and easily opened and removed from a wicket which can be manufactured quickly and economically.

Still a further object of the present invention is to provide a lipless bag capable of being supported and easily removed from a wicket which can be easily manufactured without requiring a bottom fold/side-seal process.

The bottom seal, lipless bag for wickets of the present invention comprises wicket holes positioned close enough to the sides of the bag so that the wicket holes penetrate the side gussets as well as the front and back panels of the bag, at or near the top of the bag. The bag also has front cut or score lines on the front panel and front gusset portions of the side gussets which reduce the separation force required to separate the front panel from the bag support as compared to the back panel.

In one embodiment, the bag comprises U-shaped front cut lines that begin at the top of the bag at either side of the wicket holes, and extend downward to enclose the wicket holes on the front panel and front gusset portion of the side gussets of the bag. The front gusset portion of the side gusset is that portion of each side gusset between the front panel and the gusset fold interior to the bag when the bag is in a lay-flat condition. The cut line may be discontinuous or perforated, leaving small connection points or areas which maintain a connection between the front panel and front gusset portions and an interior portion containing the respective wicket holes. The front cut lines allow the front panel and front gusset portion to be easily pulled away from the wicket. The bag can then be removed from the wicket in the same manner as a normal lip wicket bag.

In other embodiments, the front cut lines are continuous and result in a removed cut-out portion of the front panel and front gusset portions. The removed cut-out portions define cut-out areas in the front panel and front gusset portions which overlay the wicket holes of the back panel and back gusset portions when the bag is in a lay-flat condition. In these embodiments, only frictional forces between bag surfaces or, in some cases, the frictional forces between the wicket and the front panel must be overcome to open the bag. Gravity may be sufficient to pull the upper portion of the front panel away to gain access to the bag.

A number of bags may be stacked and attached by welding, fasteners, adhesives, or other attachment means. The attachment means allows a stack of bags to be moved, loaded on wickets, or stored while maintaining alignment of the top, sides, bottom and wicket holes of the bags. In other embodiments, bags are stacked and held together or blocked by the prongs of the wicket inserted into the wicket holes of the bags.

Placement of the cut lines in the portion outside of the inner gusset folds allows the cut lines to be made from the side of the bag during manufacture. The cut is made between the front panel and a backing plate inserted into the side gusset. Access to the inside of the bag is not required, simplifying and speeding the bag-making process. In this way, lipless bags provide the easy-open features of a wicketed lip bag, yet are simple and economical to make from tubes.

Some embodiments provide a continuous front cut line at each wicket hole and removal of the resulting cut-out portions. This process functionally creates a lip type bag, but allows simplified manufacturing as compared to cutting a full-length portion across the front of the bag to create the lip. Such a full length cut would require complicated and slow manufacturing steps to prevent cutting through the back panel of the bag.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a bottom-seal wicket bag made from a tube which is easily opened and removed from a wicket.

Figure 1:
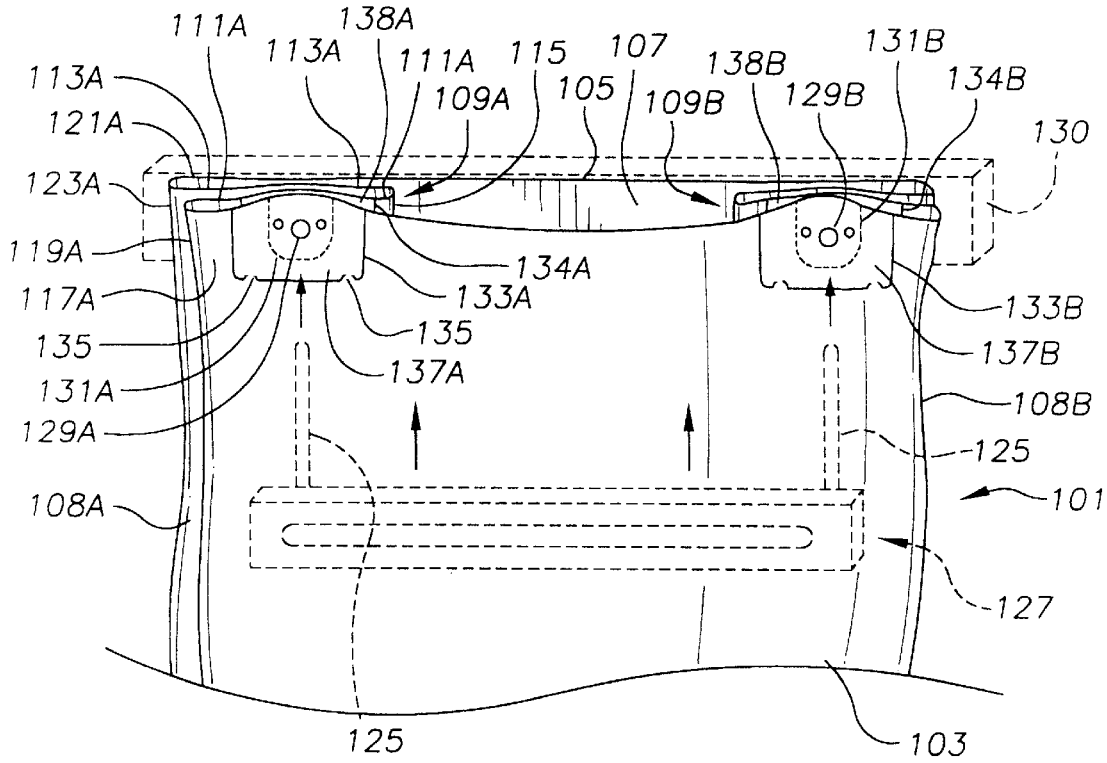
FIG. 1 is a perspective drawing of a wicket bag of the present invention showing one of a stack of bags supported by wicket holes on a wicket, the bag in a closed position on the wicket.
Figure 3:
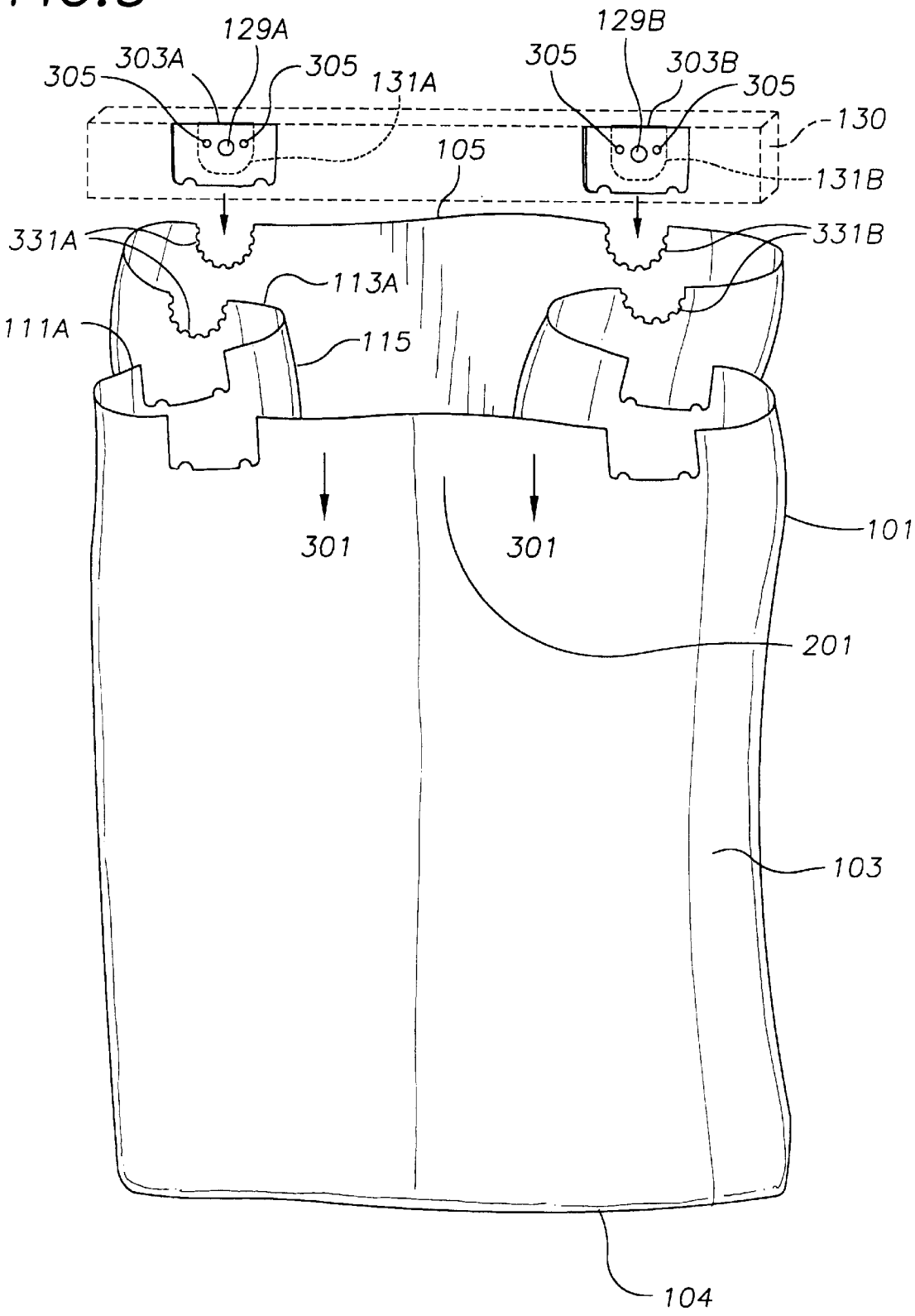
FIG. 3 is a perspective drawing of the bag of FIG. 1 completely removed from the wicket, the back panel and back gusset portions of the side gussets separated at perforations surrounding the wicket holes.

FIG. 1 is a perspective drawing of a wicket bag 101 of the present invention having a front panel 103, a back panel 105, an open top 107, and a bottom (104 of FIG. 3). In the preferred embodiment, bag 101 is made from a tube of plastic film, either seamed or non-seamed and bottom sealed.

First side 108A includes first gusset 109A which comprises front gusset portion 111A connected to back gusset portion 113A at interior gusset fold 115. Front gusset portion 111A is connected to side portion 117A of front panel 103 at fold line 119A, and back gusset portion 113A is connected to side portion 121A of back panel 105 at fold line 123A. Second side gusset 109B of second side 108B is constructed in a similar manner.

Prongs 125 of bag support or wicket 127 (shown in phantom lines) support bag 101 when inserted in support apertures or wicket holes 129A and 129B and retained by back support 130 (shown in phantom lines). Wicket hole 129A extends through front panel 103, front gusset portion 111A, back gusset portion 113A, and back panel 105. In a similar manner, wicket hole 129B extends through front panel 103, the respective front gusset portion and back gusset portion, and back panel 105. Bag 101 is supported by wicket 127 in a generally lay-flat condition. Additional bags (omitted for clarity) may be stacked and supported by wicket 127. In other embodiments, bag 101 is supported from pins (not shown) attached to back support 130 and extending through support apertures 129A and 129B.

Perforation 131A, extending from top 107 of bag 101 at either side of wicket hole 129A and enclosing wicket hole 129A provides a means to remove bag 101 when wicket 127 is engaged to wicket hole 129A. Perforation 131A extends through front panel 103, front gusset portion 111A, back gusset portion 113A, and back panel 105, and in the preferred embodiment, the perforation comprises a series of cuts along its length. Perforation 131B surrounds and encloses wicket hole 129B in a similar manner. In other embodiments, perforations 131A and 131B are omitted.

Front cut lines 133A and 134A extend downward from top 107 on either side of wicket hole 129A to enclose wicket hole 129A. In the preferred embodiment, cut lines 133A and 134A are not continuous, but rather have one or more connection areas or points 135 in the cut lines to retain front cut-out portion 137A on front panel 103 and portion 138A on front gusset portion 111A. Front cut line 133A extends through front panel 103 and cut line 134A extends through front gusset portion 111A, but they do not extend through back gusset portion 113A or back panel 105. In the preferred embodiment, cut lines 133A and 134A extend downward along front panel 103 and front gusset portion 111A sufficiently to enclose perforation 131A and wicket hole 129A. In the preferred embodiment, cut lines 133A and 134A are cut by the same die, are shaped identically and overlay each other in a lay-flat condition. Cut line 133B and 134B are similar and performs a similar function on side 108B.

Figure 2:
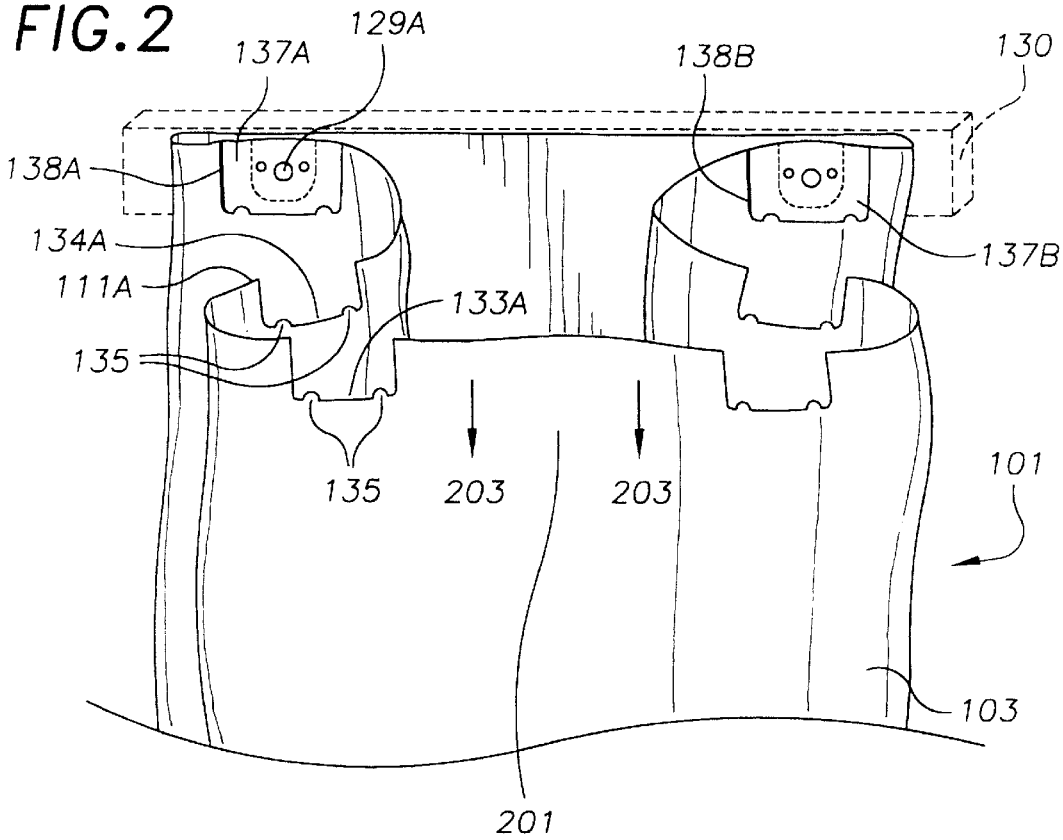
FIG. 2 is a perspective drawing of the front panel partially opened by pulling on the front panel to separate the front panel and front gusset portions of the side gussets from the wicket along front cut lines of the bag.

FIG. 2 is a perspective drawing of bag 101 of FIG. 1 being pulled or separated from back support 130. Wicket 127 of FIG. 1 is omitted for clarity. As upper portion 201 of front panel 103 is pulled down or away from support 130 in the direction of separation force 203, front panel 103 and front gusset portion 111A separate from front cut-out portions 137A, 138A along front cut line 133A of front panel 103 and front cut line 134A of front gusset portion 111A.

Front cut-out portions 137A and 138A are retained on prongs 125 of wicket 127 by wicket hole 129A. Connection points 135, being short with respect to front cut lines 133A and 134A, separate easily, allowing front panel 103 and front gusset portion 111A to be pulled away easily from wicket 127, leaving cut-out portions 137A and 138A on the wicket. The opposite side of front panel 103 and opposite front side gusset portion separate from wicket 127 in a similar manner, leaving front cut-out portions 137B and 138B retained on wicket 127.

FIG. 3 is a perspective drawing of bag 101 fully separated from wicket 127 and back support 130. Wicket 127 is omitted for clarity. Full separation occurs when upper portion 201 of front panel 103 is further pulled with additional force in the direction of arrows 301. The additional force causes separation at separated wicket perforations 331A on back gusset portion 113A and back panel 105. The portions which were inside separated perforation 331A of back gusset portion 113A and back panel 105 remain on wicket 127 at location 303A. The opposite back side gusset portion and opposite side of back panel 105 separate from wicket 127 in a similar manner, leaving portions inside wicket perforation 331B at location 303B.

Because of the small area of attachment or connection points 135 of front cut lines 133A, 133B, 134A and 134B as compared to the land areas of perforations 131A and 131B of back panel 105 and back gusset portions 113A and 113B, separation force 203 from wicket 127 of front panel 103 is less than separation force 301 of back panel 105. Likewise separation force of front gusset portions 111A and 111B is less than separation force of back gusset portions 113A and 113B.

One or more wicket welds 305 weld a plurality of bags together in the vicinity of wicket holes 129A and 129B.

Wicket welds may be formed by piercing the upper portion of a stack of bags with a heated pin (not shown). Penetration of the heated pin welds the plurality of bags together for improved handling and storage of the bags, and placement on the bagging equipment. In the preferred embodiments, front cut lines 133A and 134A, 133B and 134B, and perforations 131A and 131B enclose welds 305. In other embodiments other attachment methods such as adhesives or staples may be used to secure multiple bags.

Light force at front panel 103 releases front panel 103 and front gusset portion 111A (and opposite side front gusset portion) from wicket 127. This allows an operator to easily open bag 101 as shown in FIG. 2, even if the operation is repetitive, or traction between the operator's hand and bag 101 is poor. Also, opening by automatic equipment is facilitated. Once the front portion of bag 101 is opened, the operator can grasp the top of front panel 103, side gussets 109A or 109B, back panel 105 or the bag bottom to remove the rest of the bag. The open front affords better grip on the bag front since both sides of the bag front panel may be gripped for full separation of the bag. In other operations, front panel 103 is opened as in FIG. 2, and the bag is filled with product before the bag is removed from the wicket.

Figure 4:
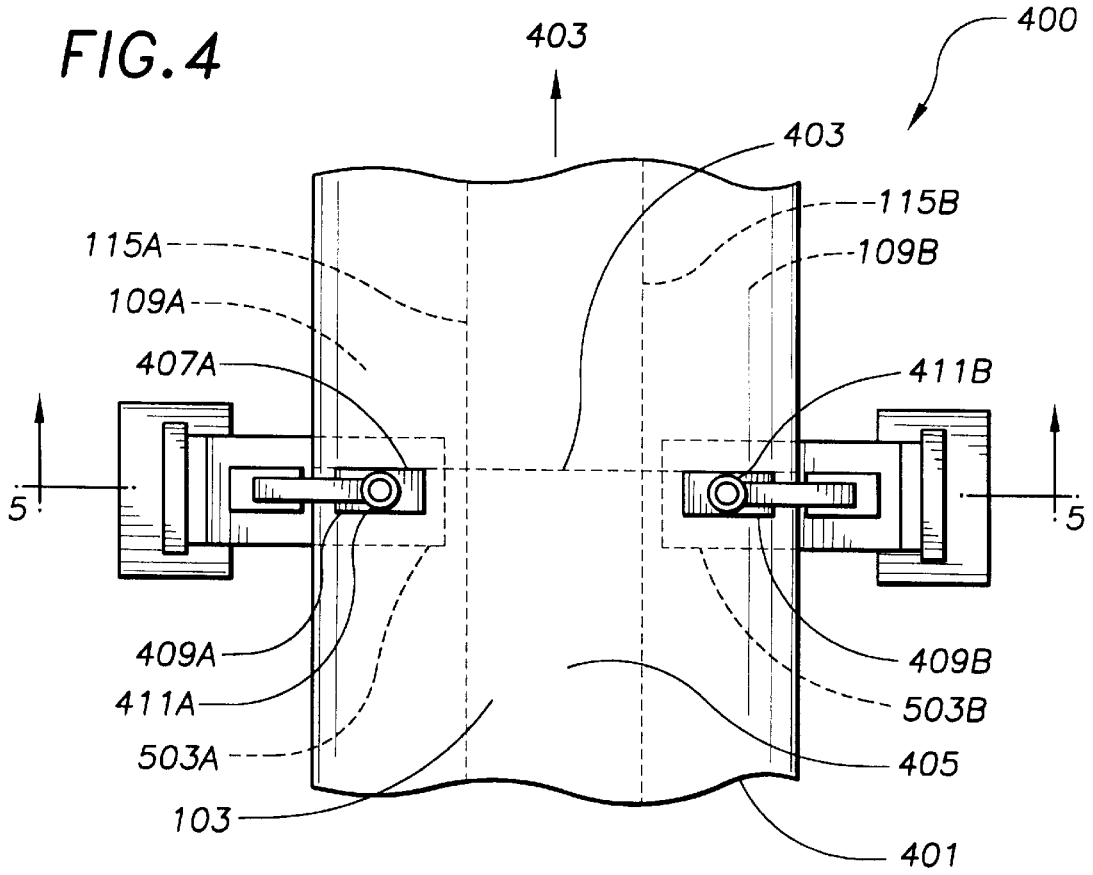
FIG. 4 is a plan view of a portion of a bag-making machine which makes the front cut lines in the front panel and the front gusset portion of the side gussets of the bag.
Figure 5:
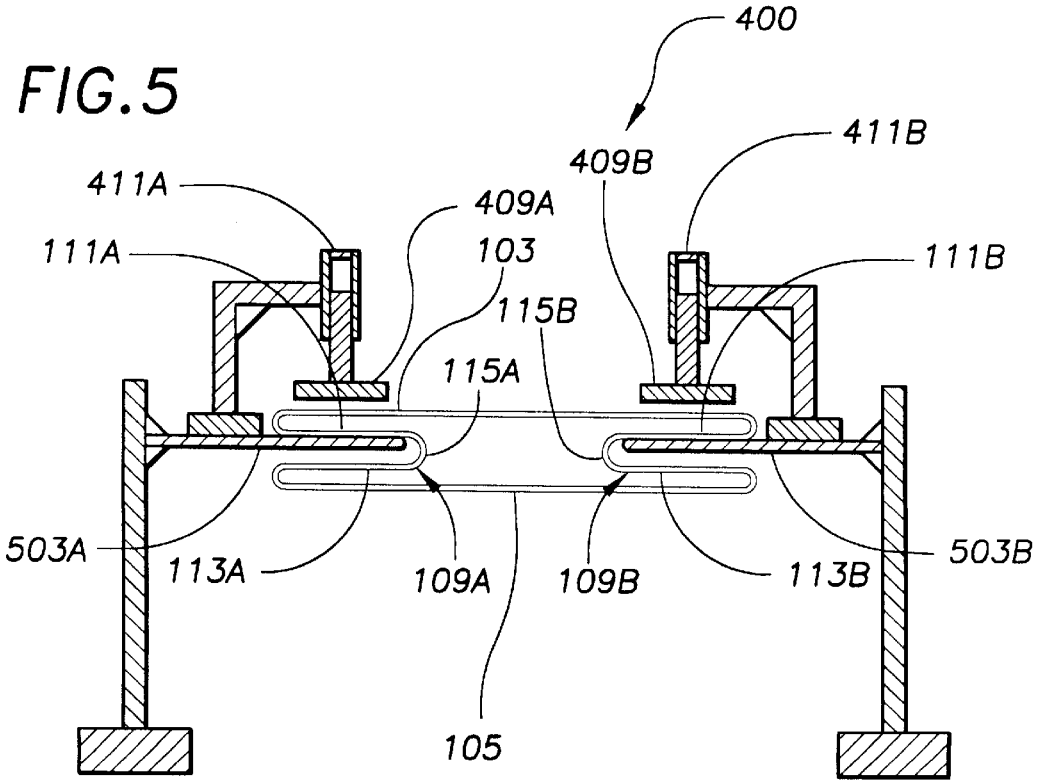
FIG. 5 is a cross section of the bag-making machine of FIG. 4 taken at lines 5—5 of FIG. 4 and showing the gusset backing panels inserted into the side gussets of the bag.

FIGS. 4 and 5 are schematic drawings of a portion of a bag-making machine 400 showing one method in which the front cut lines are produced during wicket bag manufacture. FIG. 4 is a plan view of a bag-making line showing tube portion 401 advancing in direction 403. Interior gusset fold 115A marks the inner-most portion of the of gusset 109A and interior gusset fold 115B locates the inner-most portion of gusset 109B. Gussets 109A and 109B are formed earlier on the machine as known in the art. Tube 401 advances to a predetermined position where the top position 403 of an uncompleted bag 405 is aligned with the upper portion 407A of cutting die 409A. In the preferred embodiment, tube 401 is stopped and actuator 411A inserts cutting die 409A through the front panel and front gusset portion of the bag and against backing plate 503A (FIG. 5). Actuator 411B and cutting die 409B perform a similar function on the opposite side front panel and front gusset portion.

FIG. 5 is a cross section of the machinery of FIG. 4 taken at lines 5—5. Gusset backing panels 503A and 503B, inserted in the respective folds of gussets 109A and 109B provide a backing plate for cutting dies 409A and 409B to cut front cut lines 133A and 133B of FIG. 1 in front panel 103, and cut lines 134A and 134B of front gusset portions 111A and 111B. Backing panels 503A and 503B also prevent cutting dies 409A and 409B from cutting back panel 105 and back gusset portions 113A and 113B. The thickness of the bag walls are exaggerated to improve clarity of the drawing.

Once front cut lines 133A and 133B and 134A and 134B are formed, tube 403 is advanced and bag 405 is cut along top line position 403. Bag 405 bottom is sealed, for example by seal welding as known in the art. The bags are stacked and then a punch die (not shown) cuts wicket holes 129A and 129B and perforations 131A and 131B (FIG. 1) in the stack of bags. Hot pierce needles weld the bag stack at welds 305. In this manner, wicket holes 129A and 129B of all bags in the stack are aligned coaxially. Prongs 125 of wicket 127 are easily inserted into the wicket hoes of all the bags in the stack.

In the preferred embodiments, tube 403 is a seamless tube made by the blown extrusion process. In other embodiments, seamed tubes are used. In the preferred embodiment, the film is a polyolefin such as polyethylene or polypropylene. In other embodiments, other polymeric films, including layered or composite films. In still other embodiments, paper or metallic foil films are used.

The invention is especially useful in thin film bags where wickets supporting welded stacks of bags are needed to provide adequate support for the bags due to their low rigidity. In the preferred embodiments, film thickness is 0.5–3 mills thick. In other embodiments, film thickness of 0.3–10 mills is used.

Figure 6:
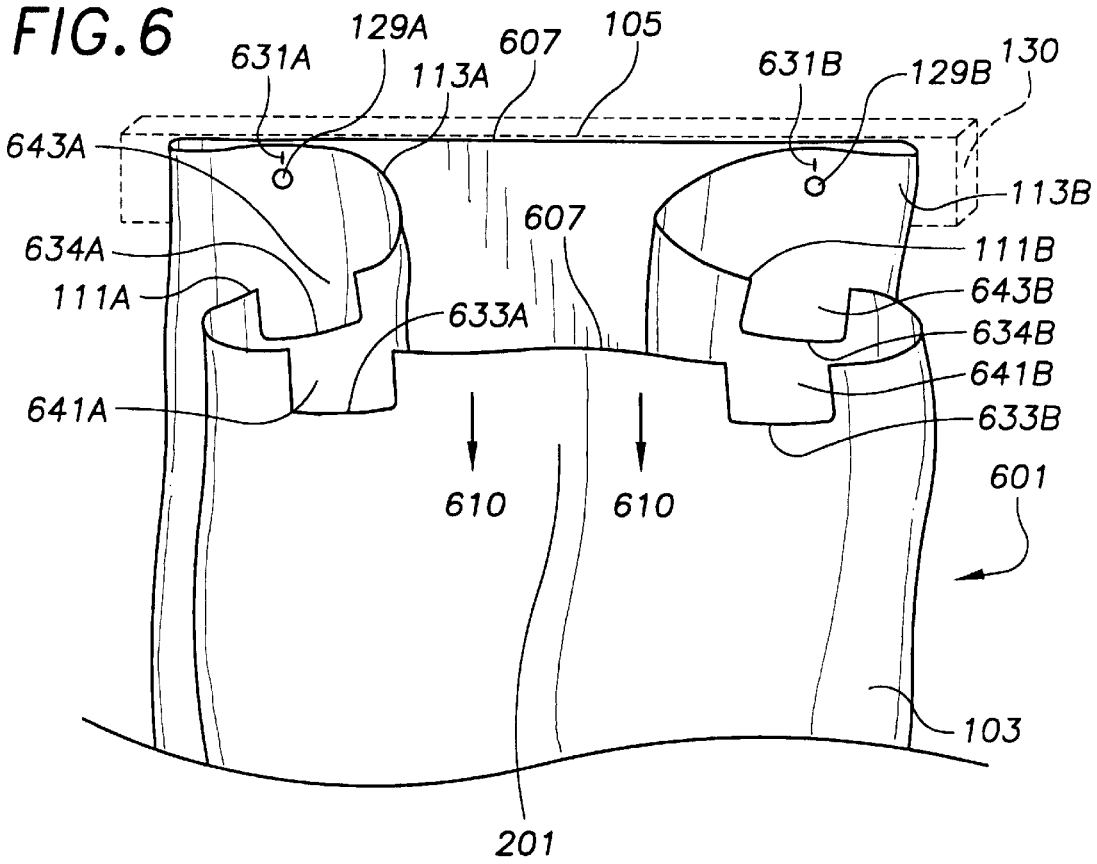
FIG. 6 is a perspective drawing of an embodiment utilizing continuous U-shaped front cut lines that define front cut-out areas of the front panel and front gusset portions enclosing the wicket holes of the back panel and back gusset portions when the bag is in the lay-flat condition.

FIG. 6 is a perspective drawing of another embodiment providing improved opening features of bottom seal bag 601. Front cut lines 633A and 633B of front panel 103 and front cut lines 634A and 634B of front gusset portions 111A and 111B are continuous, resulting in front cut-out portions (not shown) completely separated from bag 601. The front cut-out portions are removed after cutting, for example, by vacuum elements (not shown) in the machinery of FIGS. 4 and 5. Wicket holes 129A and 129B are punched in back gusset portions 113A and 113B and back panel 105 as in earlier embodiments. One or more bags 601 are supported from wicket holes 129A and 129B by a wicket such as wicket 127 of FIG. 1 (omitted for clarity).

In this embodiment, an operator or pneumatic opening equipment easily opens upper portion 201 of front panel 103 of bag 601 since there are no attachment points between front panel 103 or front gusset portions 111A and 111B and the wicket. The wicket supports back gusset portions 113A and 113B and back panel 105 from back support 130 at wicket holes 129A and 129B. This embodiment allows quick opening of the front portion of bag 601 for fast product insertion, or alternatively, easy grasping for removal of the bag from wicket 127 of FIG. 1. Slits 631A and 631B provide a means to easily remove the back gusset portions and back panel 105 from wicket 127 by providing a reduced tear length to top edge 607.

Separation or front opening force 610 may be low enough so that removal of the previous bag of the stack (not shown) from the wicket provides sufficient opening force through sliding friction of the back panel of the previous bag with front panel 103. In other wicket designs, gravity is sufficient to provide an opening force 610 sufficient to open front panel 103 and front gusset portions 111A and 111B. Front cut-out areas 641A and 641B resulting from respective front cut lines 633A and 633B and front cut-out areas 643A and 643B resulting from cut lines 634A and 634B overlay wicket holes 129A and 129B in a lay-flat condition. The front cut-out areas of the front panel and side gussets, and wicket holes 129A all lie outside the inner gusset fold (115A and 115B of FIG. 5).

Since cut-out areas 641A and 641B result in no physical connection between wicket 127 and front panel 103, the separation force for front panel 103 is significantly less than the separation force for back panel 105. Likewise, cut-out areas 643A and 643B result in a separation force of front gusset portions 111A and 111B somewhat less than back gusset portions 113A and 113B.

Figure 7:
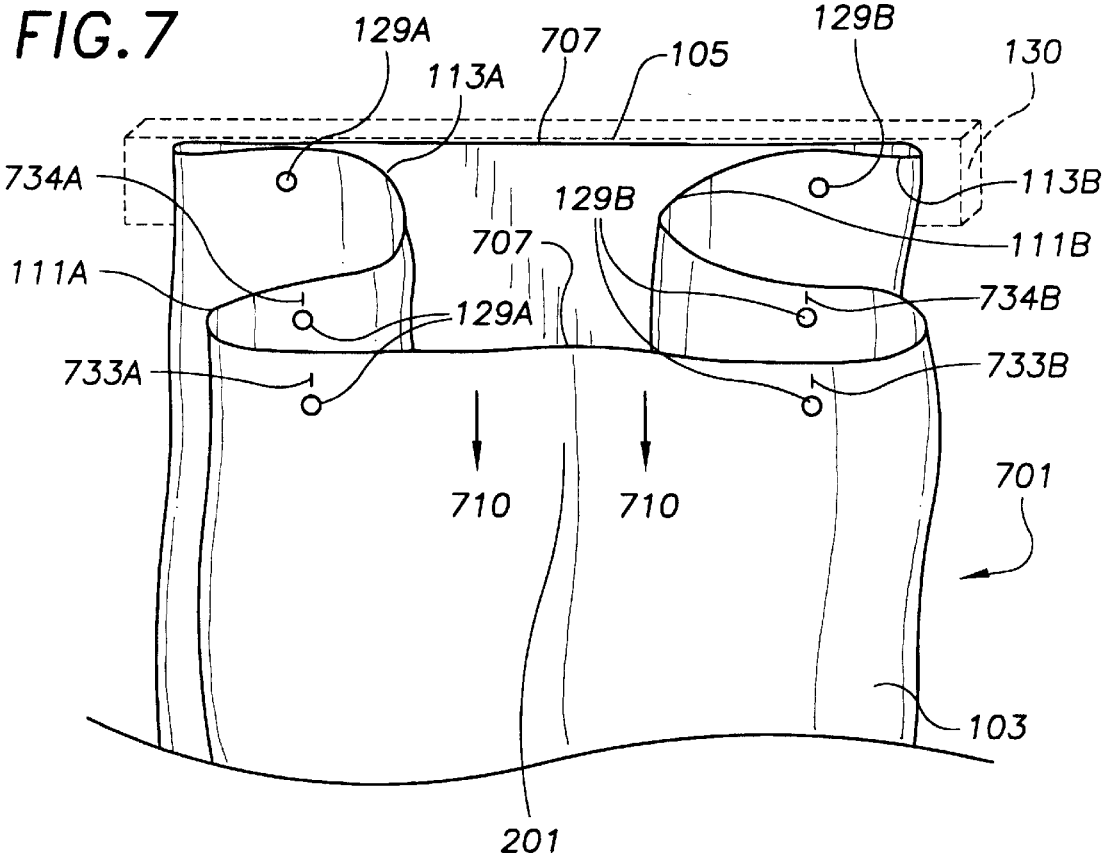
FIG. 7 is a perspective drawing of an embodiment utilizing slits as front cut lines that reduce the separation force required to separate the front panel and the front gusset portions from the wicket prongs as compared to the back panel and back gusset portions.

FIG. 7 is a perspective drawing of another embodiment of bottom seal bag 701 wherein the front cut lines on the front panel and front gusset portions are slits between the wicket holes and top edge 707. Slits 733A in front panel 103 and 734A in front gusset portion 111A and slits 733B in front panel 103 and 734B in front gusset portion 111B reduce the pulling or separation force 710 required to separate upper portion 201 of front panel 103 and front gusset portions 111A and 111B from the wicket prongs (similar to 125 of FIG. 1). The separation force 710 is less than that required to separate back gusset portions 113A and 113B and back panel 105 from the wicket prongs since there are no slits present between wicket holes 129A and 129B of the back gusset portions 113A and 113B and back panel 105 and top 707.

Alternatively, if slits such as 631A, 631B of FIG. 6 are made in the back panel and back gusset portions, longer or additional slits are made in the front panel and front gusset portions to ensure the separation force for the front panel and front gusset portions is less than the separation force for back panel 105 and back gusset portions 113A and 113B. In this case, the longer or additional slits in the front panel and front gusset portions become the front cut portions for this embodiment.

Accordingly the reader will see that BOTTOM SEAL BAG FOR USE WITH WICKETS provides a bottom seal bag which is easily opened and removed from a support wicket. The bag provides the following additional features:

Operator fatigue for repetitive packaging operations is reduced;

The bag provides uniform product fitting as compared to non-gusseted bags;

No access to the inside of the bag is required during manufacture; and

Manufacturing from continuous thin-film tubes reduces cost;

Although the description above contains many specifications, these should not be construed as limiting the scope of the invention but as merely providing illustrations of some of the presently preferred embodiments of this invention. For example, only one wicket hole may be used in the bag, or multiple wicket holes in each gusset portion may be used. Thus the scope of the invention should be determined by the appended claims and their legal equivalents, rather than by the examples given.

I claim:

1. A bag for packaging articles supportable from a bag support, the bag comprising:

a fully open top comprising a top edge, a bottom, a front panel, a back panel;

a side gusset, the side gusset comprising a front gusset portion connected to the front panel and a back gusset portion connected to the back panel;

a support aperture adjacent to the top edge and engageable with the bag support, the support aperture extending through the front panel, the back panel and the side gusset, the front panel and front gusset portion separable from the bag support by a first separation force and the back panel and back gusset portion separable from the bag support by a second separation force;

a discontinuous front cut line disposed on said front panel and the front gusset portion only, the front cut line cooperating with the support aperture and the top edge of the bag to reduce the first separation force as compared to the second separation force.

2. The bag of claim 1 wherein the bag is a bottom seal bag.

3. The bag of claim 1 comprising a first side gusset comprising a first front gusset portion connected to the front panel and a first back gusset portion connected to the back panel, and a second side gusset comprising a second front gusset portion connected to the front panel and a second back gusset portion connected to the back panel;

a first support aperture and a second support aperture for supporting the bag, the first support aperture extending through the front panel, the first gusset, and the back panel, and the second support aperture extending through the front panel, the second gusset and the back panel;

a first discontinuous front cut line disposed on the front panel and the first front gusset portion and a second discontinuous front cut line disposed on the front panel and the second front gusset portion;

wherein the first front cut line cooperates with the first support aperture and the top of the bag and the second front cut line cooperates with the second support aperture and the top of the bag to reduce the first separation force as compared to the second separation force.

4. The bag of claim 1 wherein the discontinuous front cut line on the front panel comprises a discontinuous slit between the support aperture on the front panel and the front gusset portion and the top edge of the bag.

5. The bag of claim 1 wherein the front cut line on the front panel and front gusset portion comprises a discontinuous cut line enclosing the support aperture on the front panel and extending to the top edge of the bag.

6. The bag of claim 5 wherein the front cut line is U-shaped.

7. A bag for packaging articles supportable from a bag support, the bag comprising:

a top, a bottom, a front panel, a back panel;

a side gusset, the side gusset comprising a front gusset portion connected to the front panel and a back gusset portion connected to the back panel, the front gusset portion and the back gusset portion joined at an interior gusset fold;

a support aperture in the front panel, back panel, and side gusset disposed adjacent to the top of the bag and outside the interior gusset fold when the bag is in a lay-flat condition, the front panel and front gusset portion separable from the bag support by a first separation force and the back panel and back gusset portion separable from the bag support by a second separation force;

a discontinuous front cut line in the front panel and front gusset portion, the front cut line defining a removable portion of the front panel and the front gusset portion disposed near the top of the bag and outside the interior gusset fold when the bag is in a lay-flat condition;

whereby the front cut line cooperates with the support aperture and the top of the bag to reduce the first separation force as compared to the second separation force.

8. The bag of claim 7 wherein the removeable portion of the front panel and the front gusset portion are overlying, and of greater area than, the support aperture when the bag is in a lay-flat condition.

9. The bag of claim 7 wherein the discontinuous front cut line is a generally U-shaped line with either end terminating at the top of the bag.

10. The bag of claim 7 wherein the discontinuous front cut line comprises a U-shaped perforated line disposed with either end terminating at the top of the bag and enclosing the support aperture in the front of the bag.

11. A bag stack and wicket assembly for dispensing bags, the assembly comprising;

a plurality of bags, each of said plurality of bags comprising an open top, a closed bottom, a front panel, a back panel, a side gusset, the side gusset comprising a front gusset portion connected to the front panel and a back gusset portion connected to the back panel, a pair of wicket apertures disposed adjacent to the top of the bag in the front panel, the front gusset portion, the back panel and the back gusset portion for supporting the plurality of bags from a wicket inserted into said pair of wicket apertures from a front panel end of said plurality of bags, the front panel of each of said plurality of bags being separable from the wicket by a first separation force and the back panel being separable from the wicket by a second separation forcer; and at least one discontinuous front cut line in the front panel and front gusset portion only, the front cut line cooperating with said pair of wicket apertures and the top of the bag to reduce the first separation force as compared to the second separation force;

said each of said plurality of bags attached to each other so that each of said pair of wicket apertures in said each of said plurality of bags is aligned coaxially.

12. The bag stack of claim 11 wherein said plurality of bags are attached to each other by at least one heat seal disposed near the top of said each of said plurality of bags.

* * * * *